United States Patent [19]

Bynre et al.

[11] 4,281,671

[45] Aug. 4, 1981

[54] PRODUCTION OF TOBACCO SMOKE FILTERS

[75] Inventors: Stanley W. Bynre, North Crawley; Barry J. Tompkins, Stony Stratford; Ernest B. Hayes, Newcastle-upon-Tyne, all of England

[73] Assignee: American Filtrona Corporation, Richmond, Va.

[21] Appl. No.: 31,475

[22] Filed: Apr. 19, 1979

[30] Foreign Application Priority Data

Apr. 21, 1978 [GB] United Kingdom ..... 15957/78

[51] Int. Cl.[3] ..... A24D 1/04

[52] U.S. Cl. ..... 131/335; 156/296; 428/375; 493/49

[58] Field of Search ..... 93/1 C, 77 FT; 131/9, 131/261 R, 261 A, 10.7, 10.9; 428/375; 156/296, 441, 201

[56] References Cited

U.S. PATENT DOCUMENTS

| | | | |
|---|---|---|---|
| 2,815,760 | 12/1957 | Schreus et al. | 93/1 C |
| 3,313,306 | 4/1967 | Berger et al. | 131/10.7 |
| 3,339,558 | 9/1967 | Waterbury | 131/10.1 |
| 3,371,000 | 2/1968 | Davenport et al. | 156/441 |
| 3,428,049 | 2/1969 | Leake et al. | 131/9 |
| 3,456,386 | 7/1969 | Holden | 131/261 R |
| 3,482,579 | 12/1969 | Davis | 131/9 |
| 3,546,325 | 12/1970 | Muller | 156/441 |
| 3,800,676 | 4/1974 | Levers et al. | 93/1 C |
| 3,853,039 | 12/1974 | Haslam et al. | 131/133 R |
| 3,903,893 | 9/1975 | Ryan | 131/261 R |
| 3,910,166 | 10/1975 | Sextone | 93/1 C |
| 4,024,012 | 5/1977 | Sigmon | 93/77 FT |
| 4,059,119 | 11/1977 | Grossman | 131/9 |
| 4,179,323 | 12/1979 | Sigmon | 156/201 |

FOREIGN PATENT DOCUMENTS

| | | | |
|---|---|---|---|
| 248946 | 3/1963 | Australia | 131/261 R |
| 603333 | 8/1960 | Canada . | |
| 1351210 | 4/1974 | United Kingdom . | |
| 1475576 | 6/1977 | United Kingdom . | |
| 1520583 | 8/1978 | United Kingdom . | |

*Primary Examiner*—William R. Dixon, Jr.
*Attorney, Agent, or Firm*—Holman & Stern

[57] ABSTRACT

Tobacco smoke filters comprising a rod of tobacco smoke filtering material, such as cellulose acetate tow including a thread incorporated therein or a tape wrapped therearound, the thread or tape carrying a smoke-modifying agent, such as a flavoring material and methods and apparatus for forming such filters.

7 Claims, 8 Drawing Figures

11
16
2
22
42
44
46
26
49
48
15
28
20
32
30
34
35
36
38
40

50

PRODUCTION OF TOBACCO SMOKE FILTERS

This invention relates to tobacco smoke filters, and in particular to such filters incorporating a smoke-modifying agent which in use becomes entrained in the smoke passing through the filter; the agent is frequently one which affects the taste and/or aroma of the tobacco smoke.

Heretofore, in the continuous production of filters incorporating such an agent, it has been the practice to apply the agent uniformly over the filtering material before the latter is gathered and shaped to form the filter product. For example, in the production of flavored filters of bonded cellulose acetate filamentary tow a liquid plasticizer such as triacetin, which subsequently effects the bonding between adjacent filaments, is usually sprayed uniformly over the tow before it is gathered to its final rod form, and the agent is normally dissolved in this liquid plasticizer. This procedure is satisfactory as far as supply and application of the agent is concerned, but causes practical problems when use of the agent is to be terminated or when one agent is to be substituted for another. This is because the whole of the spray booth within which the plasticizer is applied will be contaminated with the first agent employed, so that if subsequently produced filters are not to be contaminated likewise, it is necessary to stop production, and clean or replace the contaminated booth. Such enforced shutdown periods, the additional capital cost of having to carry additional substitute plasticizer spray booths, and the expense of cleaning contaminated booths (which is time consuming and can employ large volumes of expensive solvent, e.g., of liquid plasticizer) appreciably impair the efficiency of the filter production.

According to the present invention in the continuous production of a tobacco smoke filter rod by continuously advancing a supply of tobacco smoke filtering material, continuously condensing the advancing material to rod form, and continuously severing the resulting rod into individual lengths, an agent of the type under consideration is incorporated in the filter product by continuously entraining with the advancing supply of tobacco smoke filtering material a continuous thread or tape carrying the agent as or before the smoke filtering material is condensed to rod form, whereby the thread or tape becomes incorporated in or on the body of the product rod and extends continuously longitudinally thereof.

The present invention also provides a tobacco smoke filter comprising a rod of tobacco smoke filtering material having a said agent concentrated in and/or adjacent to at least one thread or tape incorporated in or on the body of the rod and extending continuously longitudinally thereof. There may be a little migration of the agent from the or each said thread or tape in the adjacent region of the finished rod.

Where a thread is employed to carry the agent, it will usually be incorporated within the body of the rod. Where a tape is employed, this might also be incorporated within the body of the rod, but could instead be wrapped around the filtering material as it is condensed to rod form so as to constitute a tubular peripheral layer of the finished rod. The tape could have the agent printed or painted over restricted regions of its surface. The tape could be of paper, or of bonded filaments of cellulose acetate tow and would preferably be embossed, e.g., with longitudinally extending corrugations.

The invention is applicable with advantage to ventilated filters, which have a porous or perforated wrapper through which in use, external air is drawn to dilute the smoke passing through the filter. The diluting air tends to travel along the peripheral region of the filter, so that a smoke-modifying thread or tape extending along the filter core, where the smoke concentration is highest, puts the smoke-modifying agent to use most effectively and economically.

The invention also provides an apparatus for the production of a tobacco smoke filter rod incorporating a said agent, the apparatus comprising means for continuously advancing a supply of tobacco smoke filtering material, a device for continuously forming the advancing filtering material to a coherent rod, a cutter for severing the resulting continuous rod into individual lengths, an applicator for applying a solution to a thread or tape passing continuously therethrough, and means for continuously passing a thread or tape through the applicator and into entrained engagement with the filtering material upstream of the said device.

The thread or tape employed according to the invention may be of any form of innoxious material provided that it takes up the agent and releases it subsequently during use of the filter. The thread or tape will preferably be a textile material, e.g., one or more monofilaments, a yarn or silver or twine, or a woven or non-woven ribbon. Where the tobacco smoke filtering material employed is a filamentary tow which is advanced longitudinally and continuously to the device which condenses it to rod form, one or more filaments of the advancing tow may be diverted from the main tow stream, passed through an applicator which applies the agent thereto, and then recombined with the remainder of the tow as or before it is condensed to rod form. However, the currently preferred substrate for the agent is sewing thread. Sewing thread is preferred because of its uniformity. The identity of the thread is not critical, and it may be of natural and/or synthetic fibers. Rayon is one material which can be used satisfactorily for the thread, but the preferred material is cotton, especially mercerized cotton as employed for good quality sewing thread. A good quality thread is preferred because of its particularly good uniformity which helps to ensure uniform takeup of the agent per unit length and hence uniform rate of incorporation of the agent in the filter product. Cotton also increases in strength when wet, an advantage when the agent is applied to the thread in solution.

It is, of course, possible for a given thread to carry two or more of the agents; two or more threads carrying the same or different agent, can be incorporated; and both tape and thread could be used. The or each thread may be colored, so as to be visible at each end of an individual rod length; in this case, different colors can be employed to indicate different flavors.

The smoke-modifying agent employed may be one which imparts an additional taste or aroma to the smoke passing through the filter in use, but agents having other effects (e.g., that of suppressing certain flavors or aromas) can be used. Purely for convenience, the following further description is mainly in terms of use of the preferred substrate sewing thread carrying a flavor-imparting agent (for example, menthol, tobacco flavor, licorice, etc.), but it is to be understood that where the context allows this description is applicable also to other agents which become entrained in the smoke drawn through the filter and modify it, and to threads and tapes in general.

The agent is preferably applied to the or each thread immediately before the thread is incorporated in the advancing filtering material; the thread can, for example, be passed through a solution of the agent and then fed directly to the advancing filtering material, preferably via a metering device such as a die, absorbent pad, or nip rollers for ensuring uniform delivery of the solution by the thread by removal of excess solution therefrom. The solvent for the agent will be chosen to be compatible with the filtering material and any other component of the filter product. For example, where the filtering material is cellulose acetate a suitable solvent would be triacetin, and in the case of a filter made from longitudinally corrugated paper ("Myria") a suitable solvent would be polyethylene glycol. The unit for applying solution to the thread or threads will normally be enclosed to prevent escape of vapor into the surrounding atmosphere, and/or suction can be applied immediately above the bath to remove vapor for venting or for condensation and recovery.

Any one or more of numerous factors may be controlled to control the rate of incorporation of the or each agent in the filter product. Such factors include choice of the thread, since the amount of solution per unit length that it will take up and retain will depend upon the material(s) of which it is made and its structure and thickness; the diameter of the die or the pressure of the nip rollers, or like parameter of whatever metering device is employed to regulate the takeup of solution by the thread; the concentration of the agent in the solution; and the number of threads incorporated. It is preferred that the thread should be saturated or nearly saturated with the solution before leaving the solution, and the length of travel through the solution will thus preferably be chosen to permit this; the minimum length of travel for saturation would of course increase with increased machine speed.

The method according to the invention is especially suitable for the incorporation of the agent in a filter of bonded filamentary cellulose acetate tow. In one such procedure, the continuously advancing tow is banded, sprayed with a liquid plasticizer such as triacetin, and then passed through a conventional wrapping garniture in which it is gathered to rod form and enwrapped in a paper wrapper which is secured around the formed rod by a lapped and stuck seam, the wrapped rod emerging continuously from the garniture being severed into individual lengths. In this embodiment, at least one thread carrying a controlled amount of agent, applied, for example, by passage through a solution of the agent as described above, is preferably continuously incorporated into the tow to move in unison therewith after the application to the tow of the liquid plasticizer, and most preferably as the tow is being gathered and condensed into rod form. Incorporation of the or each thread in this way just as the filter material is being gathered and condensed to rod form is advantageous whatever the identity of the filtering material. For start up, the or each thread can be manually threaded along its intended path and secured in any convenient manner (e.g., by an adhesive strip) to the filtering material at or upstream of the point where the filtering material is condensed to rod form, so that on switching on the machine the thread is passed through the rod forming stages along with the filtering material; thereafter, the engagement between thread and filtering material is normally sufficient to cause the thread to be continuously entrained by the advancing filtering material and drawn from its supply via the solution or other means for applying the agent, but additional mechanical means can, if necessary, be provided for feeding the thread, e.g., co-operating drive rollers.

In a similar embodiment, the plasticized cellulose acetate tow may be replaced by another conventional filtering material such as a continuous supply of longitudinally corrugated paper which is continuously gathered to rod form and enwrapped by means of a conventional garniture, the thread carrying flavoring agent being entrained in the longitudinally advancing paper as or immediately before it is condensed to rod form.

Where a tape carrying the agent is employed, it is conveniently fed continuously to the rod forming apparatus in unison with and between the filtering material and the wrapping paper, thus being entrained thereby and becoming folded around the filtering material as an outer tubular layer of the rod surrounded by the wrapping paper. The tape, whether employed in this way or incorporated within the body of the rod, as described in connection with a thread, will preferably itself be of tobacco smoke filtering material.

Where the filtering material employed comprises a thermoplastic material or incorporates a heat-activatable bonding agent, the filtering material may be brought to rod form by passage through a tubular former, with steam being injected laterally into the rod as it passes through the former, thereby initiating bonding, the resulting rod on cooling being a coherent bonded body. Preferably, the filter material is carried through the tubular former via an endless, flexible, permeable tape, as described in U.K. Pat. No. 1,169,932; the tape wraps around the filter material for passage through the tubular former and subsequently separates therefrom, the steam being passed into the filter material laterally through the tape. By this method, it is possible to form a coherent, unwrapped filter rod. Such a procedure can, however, be used in the present invention only with smoke-modifying agents which are not removed wholly or to an excessive extent by the steam treatment.

The invention is further illustrated, by way of example only, with reference to the accompanying drawings, in which.

In the drawings, like reference numerals denote like items.

Figure 1:
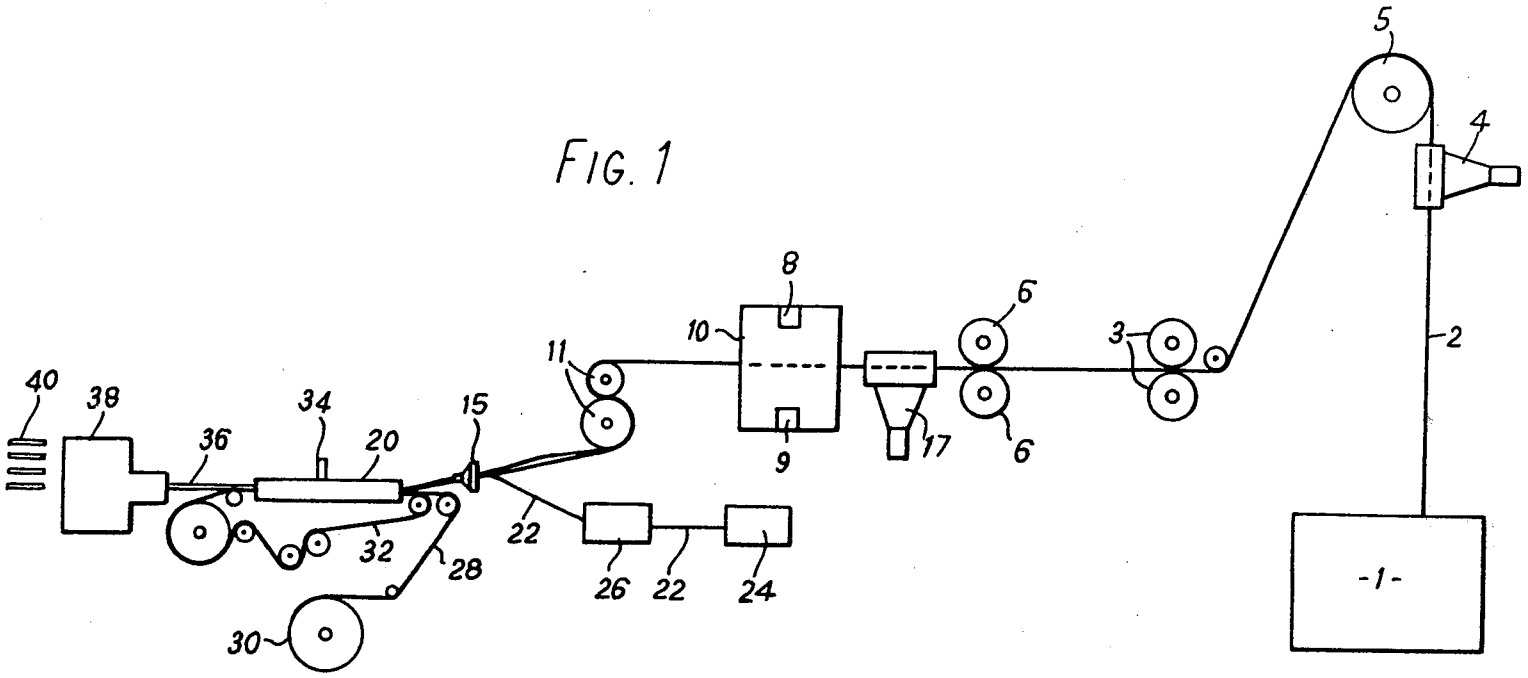
FIG. 1 is a schematic side elevation view of a complete apparatus for forming filters according to the invention.

As shown in FIG. 1, cellulose acetate tow 2 is drawn from a bale 1 through an air banding jet 4 over a cylindrical guide 5 by rollers 3. Rollers 6, which rotate faster than rollers 3, stretch the tow between themselves and rollers 3. A further air banding jet 17 forms the tow into a band approximately 250 mm wide before it passes into a box 10 where it is sprayed with glyceryl triacetate by spray guns 8 and 9. The banding jets 4 and 17 are of known form and comprise a narrow slot through which the tow passes. On one side of the slot is a perforate wall which retains the tow while the air impinges upon it. Rollers 11 hold the tow in band form until (as seen best in FIGS. 2 and 3) it passes over an upwardly convex bowed bar 16 upstream of a ring or funnel 15. This shapes the tow reaching funnel 15 into a convenient downwardly concave arch into which is positioned a thread guide mandrel 48 (FIG. 2) and gives room below the tow 2 for a flavor applicator 26—this is its preferred position since if it were situated above the tow 2, spilled flavor solution might fall onto the tow. The tow is further gathered and condensed into rod form as it enters and passes through the conventional rod-making and wrapping garniture 20. The funnel or ring 15 has an internal wall converging downstream. A thread 22 is drawn continuously from a supply 24 through the applicator 26 which applies a flavoring agent to the thread; in one instance, as shown in more detail in FIG. 2, the applicator is a bath of a solution of the flavoring agent through which the thread 22 is drawn. On leaving the applicator 26, the treated thread 22 is led directly into engagement with the tow by means of a guide mandrel 48 at a region just upstream of funnel or ring 15, and travels with the tow to and through the garniture 20 to become incorporated in and extend the length of the rod produced. On start up of the apparatus, the tow is threaded through the machine into the garniture, and the free end of thread 22 is stuck to the tow upstream of funnel or ring 15; once the apparatus has been started, the advancing tow continuously entrains the thread 22 and draws it continuously from supply 24 through applicator 26 via guide mandrel 48. Wrapping paper 28 drawn continuously from reel 30 is fed continuously into the garniture 20, the paper 28 and the tow incorporating thread 22 being carried continuously through the garniture by endless conveyor belt 32. In the garniture 20, the tow is shaped to rod form, and the paper 28 is wrapped around it and secured with a lapped and stuck seam; member 34 applies a line of adhesive to one edge of paper 28 before the overlapping edges are brought into engagement. The continuously produced wrapped rod 36 passes to a cutter 38 which severs the rod 36 into individual filter lengths 40.

Figures 2, 3, 8:
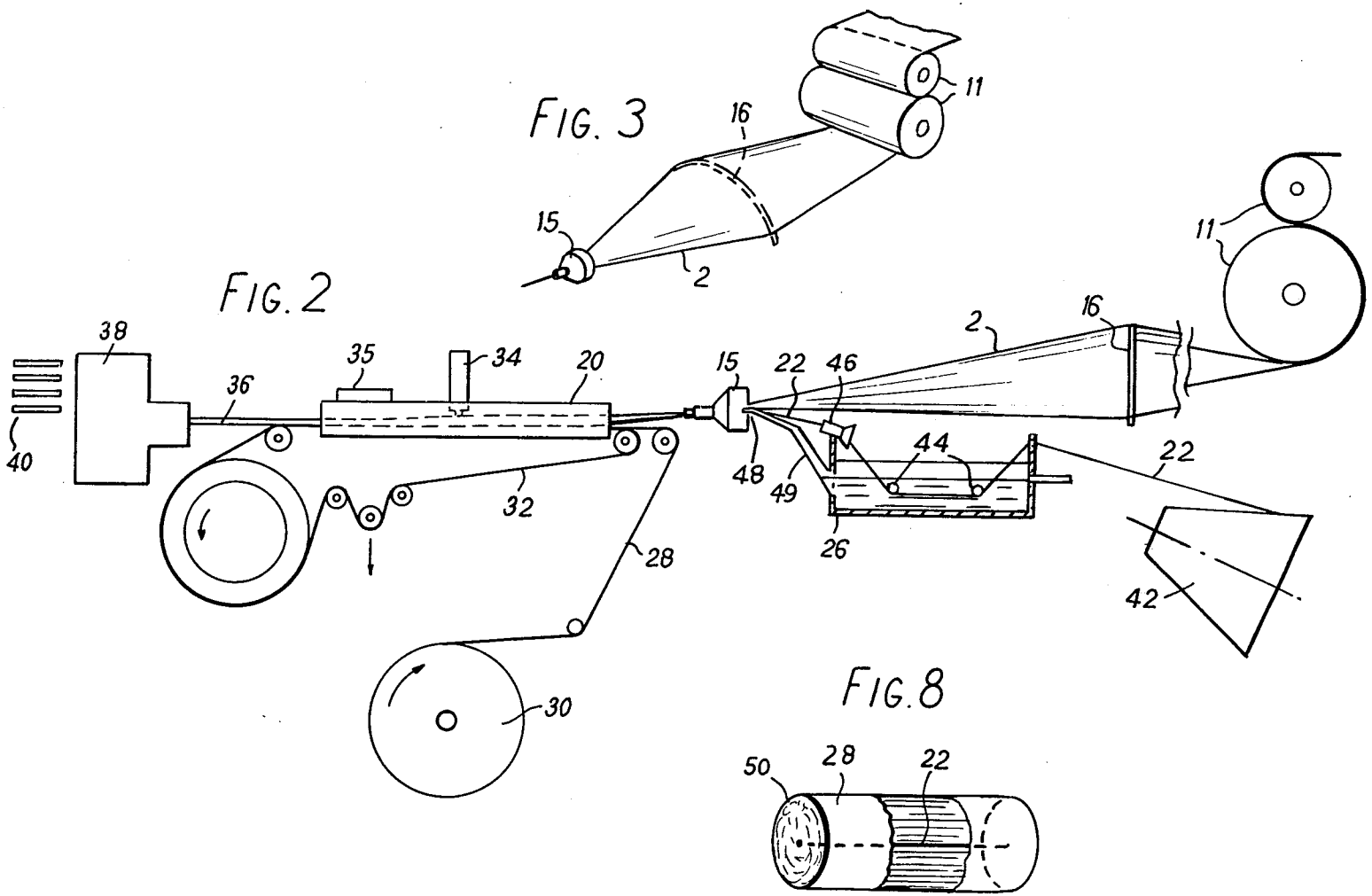
FIG. 2 shows, on an enlarged scale, but still schematically, details of the downstream portion of the FIG. 1 apparatus.
FIG. 3 shows in perspective a detail of FIG. 2.
FIG. 8 is a perspective part cut away, view of one type of tobacco smoke filter according to the invention.
Figure 4:
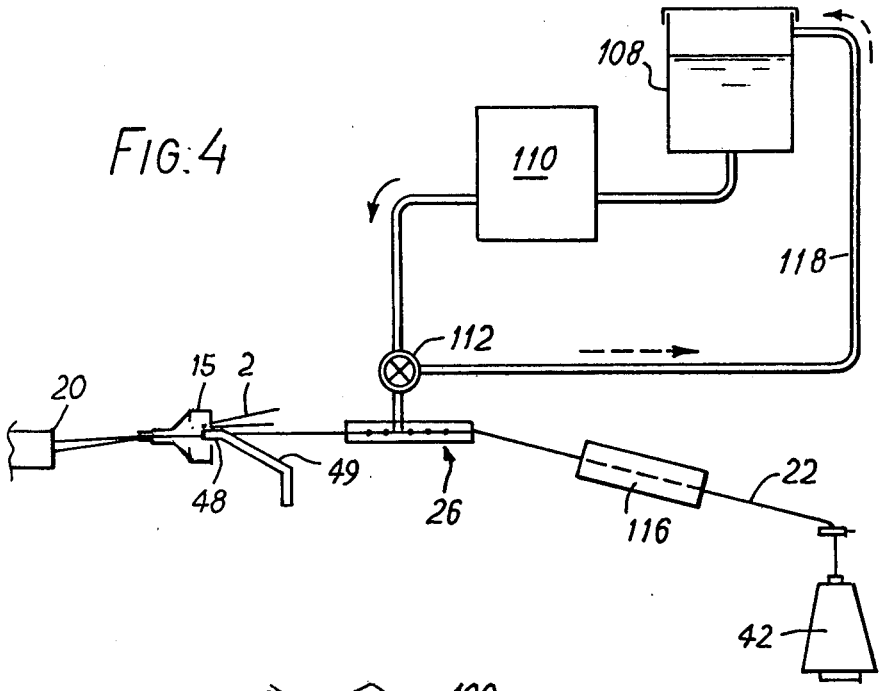
FIG. 4 is a schematic side elevation view of a preferred flavor supply system for use instead of that shown in FIG. 2.
Figure 7:
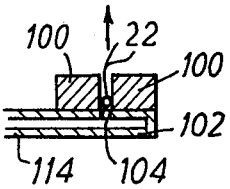
FIGS. 5, 6 and 7 are respectively perspective, plan, and sectional end elevation views of the applicator head of FIG. 4.
Figure 5:
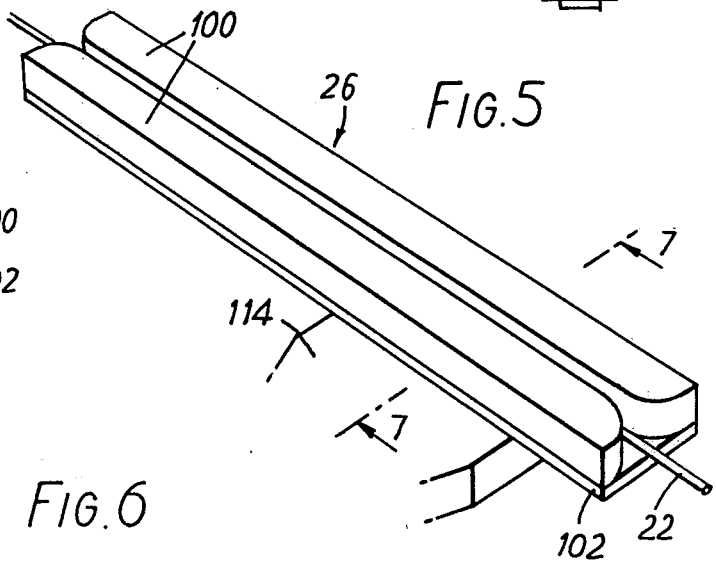
Figure 6:
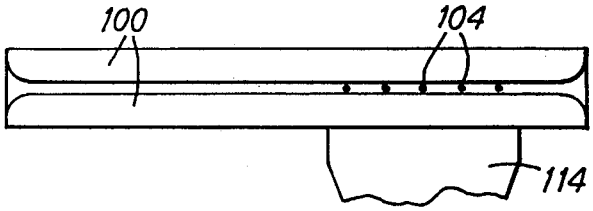

FIG. 2 shows the incorporation of the thread 22 in the tow in greater detail. Ideally, the application apparatus is located on a mounting giving 3-axis movement. This gives adjustment facility to the guide mandrel 48 for threading up and positioning of the thread in the tow. The thread 22 is drawn from a cheese 42 through the bath 26 containing a solution of the flavoring to be applied. The thread is guided through the bath by guides 44, and passes from the bath through a die 46 whose diameter is such that excess solution is removed from the thread and returned to the bath, so that the treated thread incorporated in the tow has a substantially constant amount of flavoring agent per unit length. In case any solution should be removed from the treated thread 22 by the guide mandrel 48 on its passage into engagement with the tow, the mandrel 48 can be of tubular construction being open upwardly at least at its free end and extending back, as at 49 in FIG. 2, into communication with the bath 26. The bath 26 is supplied with solution and maintained at a constant level by conventional means (not shown). The treated thread 22 is entrained by the tow, and the continuous rod 36 is made and cut into lengths 40, as described with reference to FIG. 1. FIG. 2 indicates a heater 35 which may be provided to set the adhesive applied by member 34 for forming the lapped and stuck seam of the rod 36.

FIGS. 4 to 7 illustrate another way, alternative to that of FIG. 2, in which a solution of the flavoring agent may be applied to the thread. In this embodiment, the thread 22 is drawn from cheese 42 through an applicator 26 which comprises guide members 100 on a base plate 102 having orifices 104 through which a solution of the flavoring agent is supplied from a reservoir 108 by way of a metering pump 110 and a solenoid valve 112. The solution of flavoring agent is fed by metering pump 110 via valve 112, inlet conduit 114 and orifices 104 at a controlled rate compatible with the thread being used. It is preferred to supply slightly less of the solution than the maximum that the thread will absorb at the machine speed employed, to avoid overspill. The length of the applicator head 26 will of course depend on the machine speed. To ensure that the thread 22 is maintained in contact with the solution supplied through orifices 104, it passes through a tensioning device 116 upstream of the applicator head 26, the tensioning device acting to maintain thread 22 in contact with base 102. The applicator unit comprising head 26, reservoir 108, metering pump 110 and valve 112 and preferably including also a by-pass 118 from valve 112 to reservoir 108, can be provided as a compact assembly with little pipe work. Interchangeable modules are feasible and of reasonable cost in cases where cleaning on change of flavoring agent might be a problem. The thread 22 leaving applicator head 20 is led into entrainment with tow 2 via mandrel 48, and the tow incorporating the thread is subsequently handled, as described above with reference to FIG. 2. The mandrel 48 may be provided with a drainpipe 49, as in FIG. 2, for return to the reservoir 108. In a modified embodiment, the downstream end of the applicator 26 shown in FIGS. 4 to 7 is shaped to constitute a mandrel equivalent to mandrel 48, and is positioned with its mandrel portion projecting into funnel 15; the illustrated mandrel 48 with its drainpipe 49 are, thus, omitted.

In a modification (not illustrated) of the FIG. 1 embodiment, the thread 22 is replaced by a tape from a supply 24, this tape being of filter paper embossed with longitudinal corrugations. This tape is led to the applicator 26 and is then fed to the garniture 20 between the wrapping paper 28 and the tow; the tape, thus, becomes entrained between the wrapping paper and the tow in the garniture, and becomes wrapped, with paper 28, around the tow. Applicator 26, in this case, may, for example, be a printing roll which prints a solution of the smoke-modifying agent onto predetermined restricted areas of the tape.

FIG. 8 illustrates a filter according to the invention, this consisting of core 50 of cellulose acetate filaments which extend the length of the filter and are bonded to one another at points of contact by the glyceryl triacetate, the thread 22 which carries a flavoring agent and which extends through the body of the core from one end of the filter to the other, and a surrounding paper wrapper 28 which may be perforated (not shown) or air-permeable to provide a ventilated filter.

In a specific example in which filters according to FIG. 8 were made by the procedure and apparatus illustrated in FIGS. 1 and 2, the apparatus was run successively at speeds of up to 180 meters per minute.

The thread 22 employed was a colored high quality mercerized cotton sewing thread ("Sylko", Trade Mark) having a length per unit weight of approximately 29.5 meters per gram. The bath 26 was 100 mm long and the die 46, which was a split die to allow for easier threading of thread 22, had an internal diameter of 0.385 mm. The solution in bath 26 was a 3% by weight solution of commercially available tobacco flavor in a suitable solvent, and the thread leaving die 46 carried substantially 1.9 grams of solution per gram of cotton, i.e., approximately 64 milligrams per meter. The colored thread 22 in each individual filter length produced was visible at each end of the filter. Other runs have been conducted in similar fashion employing a plurality of different colored threads which are drawn from their respective supplies through bath 26 and respective dies 46 into engagement with the tow. A white thread or threads may, of course, be employed if desired; in this case, in order to detect the presence of a thread at each end of the filter rod, it may be necessary to use on the thread a "Magic Marker" prior to entry of the thread into the garniture; on cutting the continuously produced rod a colored spot then shows at each end of a cut length, this is useful for checking the location of the thread in the filtering core of the filter.

The thread can be monitored for breaks (e.g., by a photo-electric cell device now shown in the drawings).

Although now shown in FIGS. 1 to 7, the applicator 26 will normally be enclosed in a housing to preclude the escape of fumes, the thread 22 entering and leaving the housing through restricted ports.

The embodiments of the invention in which an exclusive property or privilege is claimed are defined as follows:

1. A tobacco smoke filter comprising a rod of tobacco smoke filtering material, at least one continuous element selected from thread and tape extending continuously longitudinally of said rod, and a smoke modifying agent carried by said element which in use becomes entrained in smoke passing through the filter whereby said smoke-modifying agent is connected in the area of said elongated element.

2. A filter according to claim 1 wherein said element is a thread passing longitudinally through the body of said rod.

3. A filter according to claim 2 wherein said element is a sewing thread.

4. A filter according to claim 1 wherein said element is a tape wrapped around the circumference of said rod.

5. A filter according to claim 1 wherein said filtering material is cellulose acetate tow.

6. A filter according to claim 1 wherein said agent is one affecting the taste and/or aroma of tobacco smoke.

7. A filter according to claim 1 wherein said rod is overwrapped with an air-permeable wrapping paper.

* * * * *